US007834730B2

(12) United States Patent
Nieto et al.

(10) Patent No.: US 7,834,730 B2
(45) Date of Patent: Nov. 16, 2010

(54) MOUNTING DEVICE FOR A COIL

(75) Inventors: Miguel M. Nieto, Macclesfield (GB); Anthony J. Webster, St. Helens (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/406,409

(22) Filed: Mar. 18, 2009

(65) Prior Publication Data

US 2009/0251266 A1 Oct. 8, 2009

(30) Foreign Application Priority Data

Apr. 7, 2008 (GB) ..... 0806255.6

(51) Int. Cl.
*H01F 27/06* (2006.01)
*H01F 27/29* (2006.01)

(52) U.S. Cl. ..... 336/65; 336/192

(58) Field of Classification Search ..... None
See application file for complete search history.

(56) References Cited

U.S. PATENT DOCUMENTS 4,656,450 A * 4/1987 Jarosz et al. ..... 336/83
5,694,105 A * 12/1997 Weiner ..... 336/198
6,005,465 A 12/1999 Kronenberg et al.
6,081,180 A * 6/2000 Fernandez et al. ..... 336/90
6,478,589 B2 * 11/2002 Robinson et al. ..... 439/146
6,559,749 B1 * 5/2003 Weiner ..... 336/192
6,644,989 B2 * 11/2003 Robinson ..... 439/146
6,757,180 B1 6/2004 Chiang et al.
6,847,280 B2 * 1/2005 Kung ..... 336/83
2004/0243325 A1 * 12/2004 Tate et al. ..... 702/64
2008/0055035 A1 * 3/2008 Gerhard ..... 336/84 C

* cited by examiner

*Primary Examiner*—Anh T Mai
(74) *Attorney, Agent, or Firm*—Jimmy L. Funke

(57) ABSTRACT

A mounting device includes a base plate for supporting an electrical coil and includes two or more legs that are substantially L-shaped. Each leg has a first end and a second end and the first end is secured to the base plate and the second end is in a direction away from the base plate. A contact pin extends through the second end of each leg and the legs are capable of resilient movement relative to the base plate.

19 Claims, 2 Drawing Sheets

MOUNTING DEVICE FOR A COIL

TECHNICAL FIELD

The present invention relates to a mounting device for an electrical coil, and more particularly to a mounting device for assembly on a printed circuit board (PCB).

BACKGROUND OF THE INVENTION

It is known to provide a mounting device for an electrical coil which comprises a solid substantially rigid base plate. Contact or solder pins are secured to the base plate. The coil is electrically connected to the pins. The pins are secured to a printed circuit board with little or no clearance between the base plate and the circuit board. A thermal adhesive may be applied over the coil. If the assembly is located in an environment which is subject to significant thermal cycling or vibration (such as the engine compartment of a motor vehicle), there is an increased risk of failure of mechanical and electrical joints due to stress.

US-A-2008/055035, U.S. Pat. No. 6,757,180, and U.S. Pat. No. 6,005,465 disclose known mounting devices for coils.

SUMMARY OF THE INVENTION

It is an object of the present invention to overcome the above mentioned problem.

A mounting device in accordance with the present invention comprises a base plate for supporting an electrical coil; two or more legs, which are substantially L-shaped, each leg having a first end and a second end, the first ends being secured to the base plate and the second ends being directed away from the base plate in substantially the same direction; a contact pin extending through the second end of each leg; wherein the legs are capable of resilient movement relative to the base plate.

The present invention also includes an assembly of a mounting device and an electrical coil.

By providing legs which are capable of resilient movement relative to the base plate, and my positioning the contact pins in the legs, the mounting device is better able to withstand thermal cycling and vibration.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
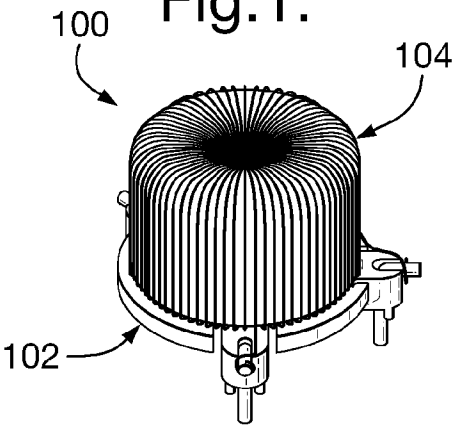
FIGS. 1 to 4 are various views of a mounting device in accordance with a first embodiment of the present invention.
Figure 2:
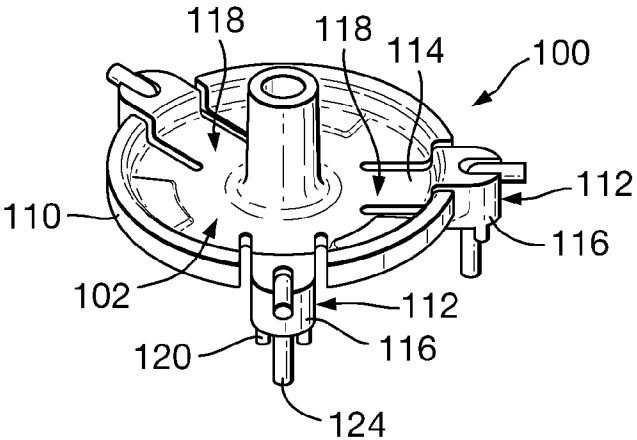
Figure 3:
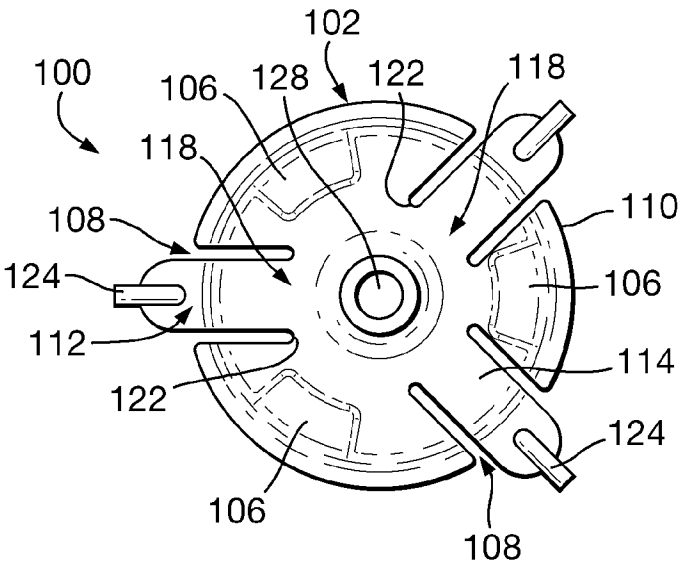
Figure 4:
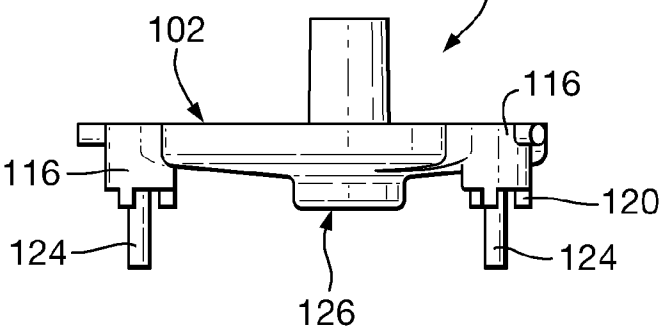

Referring to FIGS. 1-4, the first embodiment of mounting device 100 comprises a base plate 102 which is capable of supporting an electrical coil 104. The base plate 102 is substantially planar. The base plate 102 may include raised portions 106 to which adhesive can be applied to secure the coil 104 to the base plate.

Three slots 108 are formed in the base plate 102 extending inwardly, in a substantially radial direction, from the outer circumferential edge 110 of the base plate. The slots 108 are preferably substantially equidistantly spaced from one another. A leg 112, which is substantially L-shaped, is partially positioned in each slot 108. Each leg 112 comprises a first portion 114 and a second portion 116. The first portion 114 is substantially located within its respective slot 108 and lies in a plane which is substantially aligned with the plane of the base plate 102. The second portion 116 extends away from the first portion 114 in a substantially perpendicular direction. The second portions 116 extend in the same direction. Each leg 112 has a first end 118 and a second end 120. The first end 118 of each leg 112, associated with the first portion 114, is secured to the base plate 102 at the inner edge 122 of the associated slot 108. The second end 120 of each leg 112, associated with the second portion 116, is a free end directed away from the base plate 102. In an alternative arrangement, the slots 108 may be omitted, and the first end 118 of each leg 112 may be attached to the outer circumferential edge 110 of the base plate 102. The arrangement for connecting the legs 112 to the base plate 102 allows relative resilient movement between the legs and the base plate. The base plate 102 and the legs 112 may be formed separately and then secured together, but are preferably moulded in one-piece from plastics material.

A contact pin 124 extends through the second portion 116 of each leg 112 and out of the second end 120. The coil 104 is mechanically and electrically connected to two of the contact pins 124 to provide electrical power to the coil. The contact pins 124 are capable of mechanical and electrical connection to a printed circuit board (not shown), for example by soldering. The second portion 116 of the legs 112 positions the base plate 102 a predetermined distance above the printed circuit board, the distance being determined by the length of the second portion, which is predetermined as required. This arrangement provides the option of attaching other components to the printed circuit board between the printed circuit board and the base plate 102.

The base plate 102 may include a central boss 126 with a through bore 128 having an axis extending in a direction substantially parallel to the second portion 116 of the legs 112, to allow securing of the mounting device 100 to the printed circuit board by way of a screw (not shown).

Figure 6:
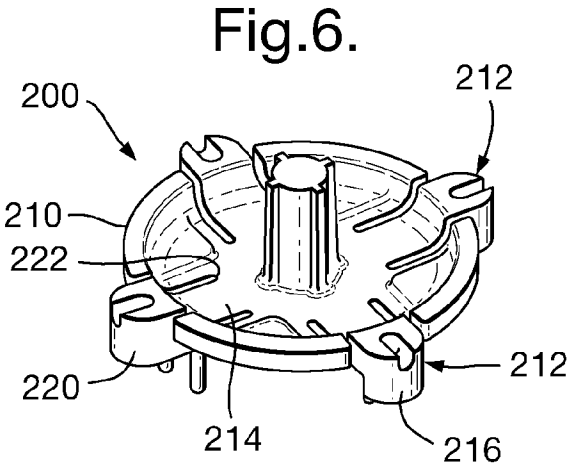
FIGS. 5 to 8 are various views of a mounting device in accordance with a second embodiment of the present invention.
Figure 8:
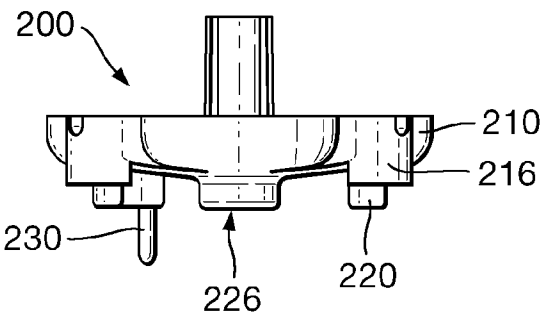
Figure 5:
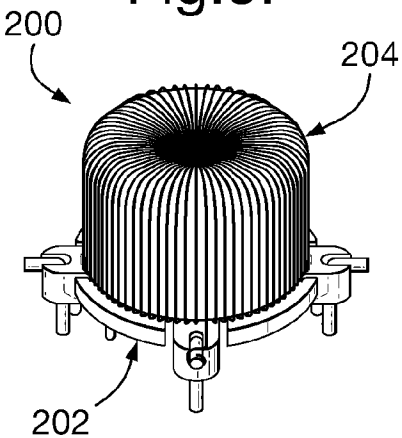
Figure 7:
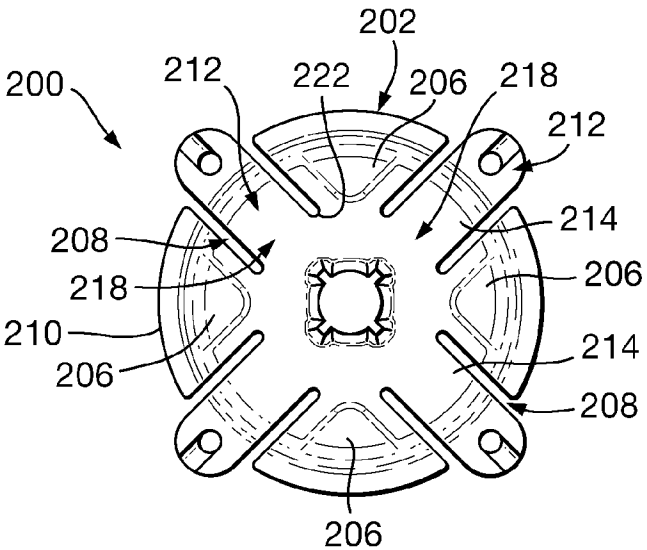

Referring to FIGS. 5-8, the second embodiment of mounting device 200 is substantially the same as the first embodiment, and like parts have been given the prefix 2. The contact pins of the second embodiment have been omitted for clarity. The second embodiment differs from the first embodiment in that the base plate 202 has four slots 208, with a leg 212 partially positioned in each slot. Other features of the second embodiment are substantially the same as the first embodiment. The second embodiment also includes a locator pin 230, integrated with the base plate 202, for providing location when mounted on a printed circuit board (not shown).

It will be appreciated that the present invention is capable of implementation using two or more legs.

By providing legs which are capable of resilient movement relative to the base plate, with contact pins in the legs, the mounting device of the present invention is better able to withstand stress associated with thermal cycling and vibration.

The invention claimed is:

1. A mounting device, comprising:

a base plate adapted for supporting an electronic component, the base plate having a plurality of elongate legs each integrally formed and extending radially outwardly from said base plate terminating in a free end portion; and a contact pin extending generally axially through the free end portion for mechanically and electrically coupling the mounting device to a host system.

2. The mounting device as in claim 1, wherein the base plate is substantially planar and includes a plane disposed along a surface of the base plate, and each elongate leg includes a first portion disposed along the plane and a second portion being the free end portion bisecting the plane and being substantially perpendicular to the plane.

3. The mounting device as in claim 2, wherein the first portion of each elongate leg is spaced apart from edges of the respective two or more slots of the base plate along a length of the first portion.

4. The mounting device as in claim 2, wherein the first portion of each elongate leg is disposed inbound from a perimeter edge of the base plate.

5. The mounting device as in claim 2, wherein a majority portion of the second portion bisects the plane beyond a perimeter edge of the base plate.

6. The mounting device as in claim 2, wherein the surface is a first surface and the base plate includes a second surface opposite the first surface, and an end of the second portion extends away substantially perpendicular to the plane in a direction beyond the second surface.

7. The mounting device as claim 1, wherein the mounting device is integrally molded in one piece.

8. The mounting device as in claim 1, further comprising a boss defining a through bore, said boss extending substantially perpendicular to a surface of the base plate.

9. The mounting device as in claim 8, wherein the boss includes a majority portion and a minority portion and the surface is a first surface and the base plate further includes a second surface opposite the first surface, and the majority portion of the boss extends away from the first surface and the minority portion extends away from the second surface, and a plane is defined along a surface of the minority portion generally parallel with the second surface, and a second end of the second portion of each leg extends in a same direction as the minority portion of the boss to the plane.

10. The mounting device as in claim 1, wherein the base plate has a circular shape.

11. The mounting device as in claim 1, further comprising an integral locator pin directed away from the base plate in substantially a same direction as the free end portion of each elongate leg.

12. The mounting device as in claim 10, wherein a plurality of pairs of slots in the base plate are substantially spaced equidistant from one another around a circumferential edge of the base plate.

13. The mounting device as in claim 10, wherein the elongate legs are substantially spaced equidistant from one another around a circumferential edge of the base plate.

14. The mounting device as in claim 10, wherein a plurality of raised portions are substantially spaced equidistant from one another around a circumferential edge of the base plate, said plurality of raised portions being in connection with the electronic component when the electronic component is secured to the base plate.

15. The mounting device as in claim 1, wherein the electronic component is an electrical coil.

16. The mounting device as in claim 1, wherein the base plate further includes at least one raised portion rising above a surface of the base plate, and the electronic component is in connection with the at least one raised portion when the base plate supports the electronic component.

17. The mounting device as in claim 1, wherein a surface of the base plate overlies a surface of the host system, and the surface of the base plate is generally in a parallel, spaced relationship with the surface of the host system, the surface of the base plate being elevated above the surface of the host system by the plurality of elongate legs.

18. An assembly, comprising:

a mounting device, including, a base plate adapted for supporting an electronic component, the base plate having a plurality of elongate legs each integrally formed and extending radially outwardly from said base plate terminating in a free end portion;

an electronic component being supported by the base plate; and a contact pin extending generally axially through the free end portion for mechanically and electrically connecting with the electronic component and for electrically and mechanically coupling the mounting device to a host system.

19. The assembly as in claim 18, wherein the base plate is substantially planar and includes a plane disposed along a surface of the base plate, and each elongate leg includes a first portion and the free end portion being the second portion, and the first portion of each elongate leg lies along the plane and the second portion of each elongate leg bisects the plane and is substantially perpendicular to the plane.

* * * * *